US007819166B2

(12) United States Patent
Militello et al.

(10) Patent No.: US 7,819,166 B2
(45) Date of Patent: Oct. 26, 2010

(54) WINDOW COVERING WITH CONSTANT LIFTING CORD FRICTION

(75) Inventors: David R. Militello, Rohnert Park, CA (US); Barry L. Shevick, Fair Oaks, CA (US)

(73) Assignee: Shades Unlimited, Inc., Cotati, CA (US)

( * ) Notice: Subject to any disclaimer, the term of this patent is extended or adjusted under 35 U.S.C. 154(b) by 194 days.

(21) Appl. No.: 12/074,963

(22) Filed: Mar. 7, 2008

(65) Prior Publication Data

US 2009/0223642 A1 Sep. 10, 2009

(51) Int. Cl.
*E06B 9/38* (2006.01)

(52) U.S. Cl. ..... 160/84.04; 160/168.1 R; 160/173 R; 160/178.2

(58) Field of Classification Search ..... 160/168.1 R, 160/178.1 R, 170, 171, 84.04, 84.05
See application file for complete search history.

(56) References Cited

U.S. PATENT DOCUMENTS 6,443,207 B1 * 9/2002 Cheng et al. ..... 160/84.04
6,845,801 B2 * 1/2005 Hsu ..... 160/84.04
7,198,087 B2 * 4/2007 Hsu ..... 160/84.01
7,373,965 B2 * 5/2008 Cheng ..... 160/178.2
7,562,689 B1 * 7/2009 Militello et al. ..... 160/84.04
2005/0274466 A1 * 12/2005 Hsu ..... 160/168.1 R
2006/0237144 A1 * 10/2006 Cheng ..... 160/84.04
2009/0223642 A1 * 9/2009 Militello et al. ..... 160/340

* cited by examiner

*Primary Examiner*—Blair M. Johnson
(74) *Attorney, Agent, or Firm*—Heisler & Associates

(57) ABSTRACT

A window covering includes an at least partially light occluding layer that can be attached to a lintel at an upper end and with a bottom rail at a lower end that can be moved to selectively cover the window. Cords are fixed to the upper end of the layer and extend past the bottom rail. The bottom rail includes a friction module which applies sufficient friction to the cords to keep the bottom rail fixed to the cords unless additional forces are applied to the bottom rail to move the rail. A pair of engagement surfaces are spring biased against the cords to apply friction forces. A lever acts on the springs to adjust for variations in friction forces so that the bottom rail remains horizontal. The bottom rail is formed of a closable structure with a cap hinged to a base for ease in forming the bottom rail.

5 Claims, 4 Drawing Sheets

WINDOW COVERING WITH CONSTANT LIFTING CORD FRICTION

FIELD OF THE INVENTION

The following invention relates to window coverings for attachment to a lintel adjacent a window for at least partially covering the window. More particularly, this invention relates to window coverings which can be adjusted by raising a bottom rail of the window covering up and down relative to an upper end of an at least partially light occluding layer of the window covering so that the window can be adjustably covered or uncovered by the window covering.

BACKGROUND OF THE INVENTION

Window coverings come in a variety of different styles and with various different functional features to best accommodate the functional need to control light and visibility through windows, as well as to provide convenience in adjustability of the window covering. Some window coverings are referred to as blinds and generally include slats therein which can be rotated in some such blinds to adjust an amount of light and visibility through the window covering. Other window coverings are generally in the form of shades which include a fabric or other planar material which can either occlude all light passing therethrough or be at least partially transparent. Shades can be planar in form or can have other geometric configurations. One such shade is formed of pleated fabric with the pleats running generally horizontally, allowing the shade to be retracted, accordion style, to allow for full visibility through the window, or deployed to completely or substantially completely cover the window.

With both shade type window coverings and blind type window coverings, control of retraction and deployment of the window covering is desirable. Often such window covering position adjustability is facilitated by suspending a bottom rail or other bottom member of the window covering from at least one cord, and typically multiple cords, extending vertically up from the bottom rail to a top rail or other upper portion of the window covering which is secured to the lintel. Because the bottom member is suspended by this cord (or cords), tension can be applied to the cord and the cord shortened to lift the bottom member and cause the window covering to the retracted. Conversely, slackening the cord allows the bottom rail to move down and for the window covering to be more fully deployed. While the bottom rail is usually fixed to an end of the cord, it can alternatively be attached to the cord in a movable fashion where the cord remains generally stationary and the bottom rail moves up and down on the cord to retract or deploy the window covering.

Various different styles of bottom rail cord suspension mechanisms are known in the prior art. Some of these systems include locking and unlocking members in the top rail so that when the cord is locked the bottom rail remains in fixed position and when the cord is unlocked it, it can be pulled or released to raise or lower the bottom rail. Standard prior art "Venetian blinds" often exhibit variations on such a cord suspension and lifting mechanism. Because excessive cord can be unsightly and potentially dangerous, especially to young children, many shades include cords which are collected within one of the rails. Typically, such window coverings include buttons on the bottom rail which act to lock or unlock the cords and allow for positioning of the bottom rail. Representative of such window coverings are U.S. Pat. Nos. 6,823,925 and 7,331,370. While such internal cord collection within the rails can be achieved, it requires complex mechanisms which are subject to potential failure and significantly increase the cost of the window covering. Cords which lock at the top rail and which are pulled to raise the window covering, have the undesirable effect of the cord being rather long when the shade is retracted, bringing the cord lower and into potential dangerous contact with children or animals. Furthermore, when shades require that buttons be pushed, manipulation of the shade typically requires two hands for proper operation. Accordingly, a need exists for window coverings which are adjustable but which minimize exposed cord, the use of buttons, and preferably can be retracted or deployed merely by pushing or pulling on the bottom rail.

Furthermore, window coverings which include cord handling mechanisms within rails thereof typically require relatively large volume rigid extrusions or other complex rigid structures and relatively large complex assembly. Accordingly, a need exists for a window covering with rails that are of a simple form but can still contain cord handling mechanisms therein and which can be easily manufactured from low cost materials. Such window coverings would also benefit from being easily sized by a user to match window width.

SUMMARY OF THE INVENTION

With this invention a window covering is provided with a bottom member suspended below an at least partially light occluding layer. The bottom member is suspended by at least one cord that has a first end fixed along with an upper end of the at least partially light occluding layer to a lintel above a window. A second end of the cord opposite the first end extends past the bottom member. A friction applying member is coupled to the bottom member and has the cord routed therethrough.

This friction applying member applies a substantially constant friction to the cord. This friction that is applied is greater than gravity forces acting on the bottom member and the at least partially light occluding layer. Thus, the bottom member remains fixed to the cord and supports portions of the at least partially light occluding layer above the bottom member and below the upper end of the at least partially light occluding layer fixed to the lintel.

The friction forces applied by the friction applying member can be overcome by applying additional forces to the bottom member. For instance, a user can grasp the bottom member and pull down on the bottom member. This downward pulling force, when sufficient, overcomes the friction forces applied by the friction applying member so that the bottom member can move down. Similarly, the cords can be held below the bottom member, either by a hand of the user or by securing to a lower lintel of the window or other structure adjacent the window, or by additional weight to enhance gravity loads, and the user merely pushing up on the bottom member with sufficient force to overcome the friction force and gravitational forces acting on the bottom member and the at least partially light occluding member, and the bottom member is caused to move up. A simple window covering is thus provided that is adjustable and can often be adjusted with only one hand.

Furthermore, the bottom member of the window covering is provided with a simple geometry to simplify costs associated with manufacturing the bottom member and with attaching to the bottom member cord handling components including the friction applying member. In particular, the bottom member is preferably in the form of an elongate bottom rail including a base portion and a cap portion which are hinged together. The base portion includes a trough therein which receives a housing having the friction applying member therein and preferably a pair of pulleys to allow the shade to operate with two cords spaced laterally from each other. The cap portion is hinged to the base portion so that after cord handling mechanisms are dropped into the trough of the base portion, the cap portion can be pivoted closed about the hinge to secure the cord handling mechanisms within the trough of the base portion and within the bottom rail of the window covering. Such a simple form allows the bottom rail to be formed in a simple stamping or vacuum forming operation, such as is often used in vacuum forming plastic either with vacuum alone or with a combination of vacuum and pressure, heat, or with platens that press against the sheet of material being worked, or combinations of vacuum, pressure, heat and/or platens, to form the entire bottom member including the base portion and the cap portion from sheets of appropriately moldable materials, such as polymeric hydrocarbon plastic materials.

A top rail can be similarly provided to add stiffness to the upper end of the at least partially light occluding layer. This top rail can merely be a thin sheet of material typically stiffer than pleated fabric if pleated fabric is provided as the at least partially light occluding layer. First ends of the cords can be secured to this top rail as well as the upper end of the at least partially light occluding layer, and the top rail can then be attached to the lintel of the window, such as through utilizing an appropriate adhesive, or some form of fastener (or both).

OBJECTS OF THE INVENTION

Accordingly, a primary object of the present invention is to provide a window covering which has a bottom rail which can be raised to retract the window covering or lowered to deploy the window covering adjacent a window to adjust the light passing through the window and visibility through the window.

Another object of the present invention is to provide a window covering which can be lowered with a single hand in an easy manner by merely gripping the bottom member and pulling down.

Another object of the present invention is to provide a window covering which can be raised and lowered by applying a lifting or lowering force to any portion of a bottom member of the window covering.

Another object of the present invention is to provide a window covering which is easy to manufacture from low cost materials.

Another object of the present invention is to provide a method for raising and lowering a bottom rail of a window covering to retract or deploy the window covering.

Another object of the present invention is to provide a window covering with cords and which cords remain substantially within a window space both when the window covering is retracted or deployed.

Another object of the present invention is to provide a widow covering which does not require any buttons or other manipulatable items to be pushed or otherwise manipulated to allow adjustment of the window covering.

Another object of the present invention is to provide a window covering which maintains a balanced and aligned form even when friction forces on two or more cords occur, such as due to irregularities in cord diameter.

Another object of the present invention is to provide a method for deploying a window covering even when the bottom rail of the window covering is out of reach of a user.

Another object of the present invention is to provide a window covering with a bottom rail that can be vacuum/pressure formed or press formed out of planar starting material.

Another object of the present invention is to provide a window covering which is easy to assemble while maintaining high quality consistent performance of the window covering.

Another object of the present invention is to provide a window covering that can be sized to a width of the window by a user in a simple fashion, leaving a clean and symmetrical appearance for the window covering.

Other further objects of the present invention will become apparent from a careful reading of the included drawing figures, the claims and detailed description of the invention.

DESCRIPTION OF THE PREFERRED EMBODIMENT

Figure 2:
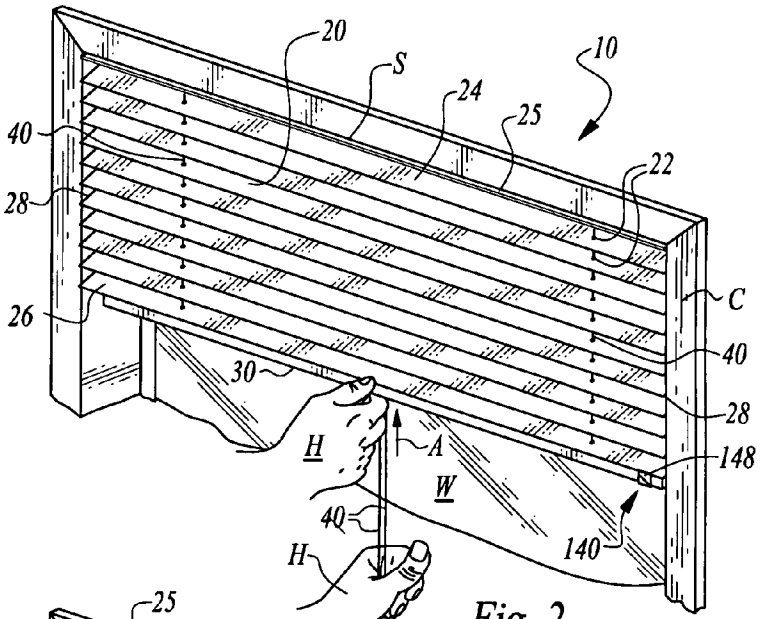
FIG. 2 is a perspective view of an upper portion of that which is shown in FIG. 1 and with the window covering shown partially retracted, and illustrating a method for retracting the window covering.

Referring to the drawings, wherein like reference numerals represent like parts throughout the various drawing figures, reference numeral 10 is directed to a preferred embodiment window covering in the form of a shade including the unique features of this invention. Portions of this invention could similarly be utilized on other forms of window coverings including blinds formed of separate slats, and other window coverings which include a bottom member which is selectively raisable or lowerable relative to cords for holding the bottom member in place when the shade 10 or other window covering is no longer being adjusted.

The shade 10 or other window covering is oriented within a casing C surrounding a window W, with upper portions of the shade 10 coupled to a lintel S defining an upper portion of the casing C surrounding the window W. The bottom member, preferably in the form of bottom rail 30, can be conveniently lowered to deploy the shade 10 merely by grasping the bottom member and pulling down on the bottom member (opposite arrow A of FIG. 2). Retraction of the shade 10 occurs by holding the cords 40 taught while pushing up on the bottom member (along arrow A), as illustrated in FIG. 2.

Figure 1:
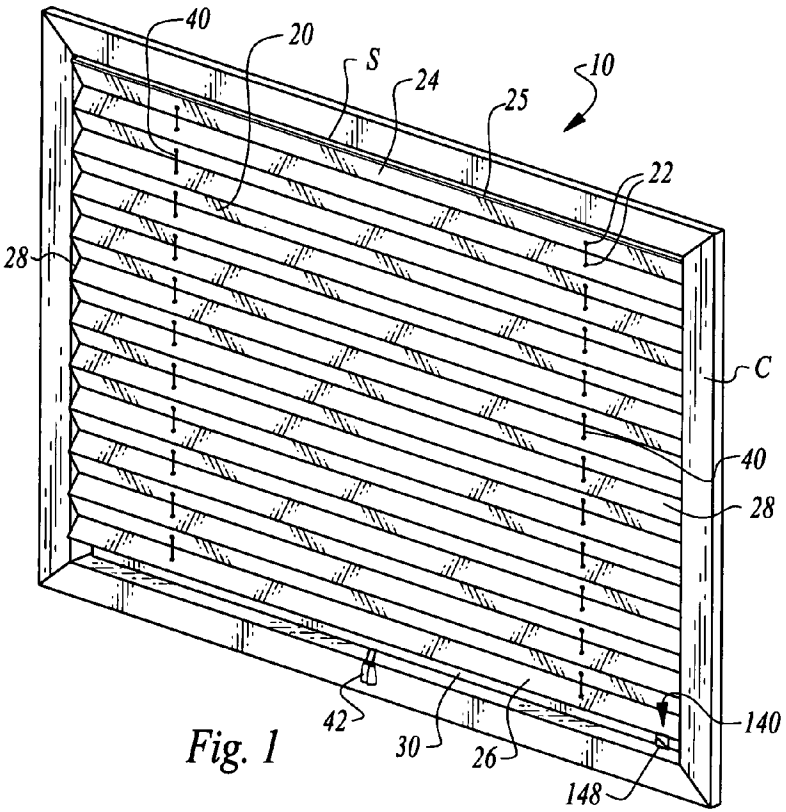
FIG. 1 is a perspective view of a window with a window covering therein according to this invention, and with the window covering shown in a deployed form.
Figures 4, 5, 6:
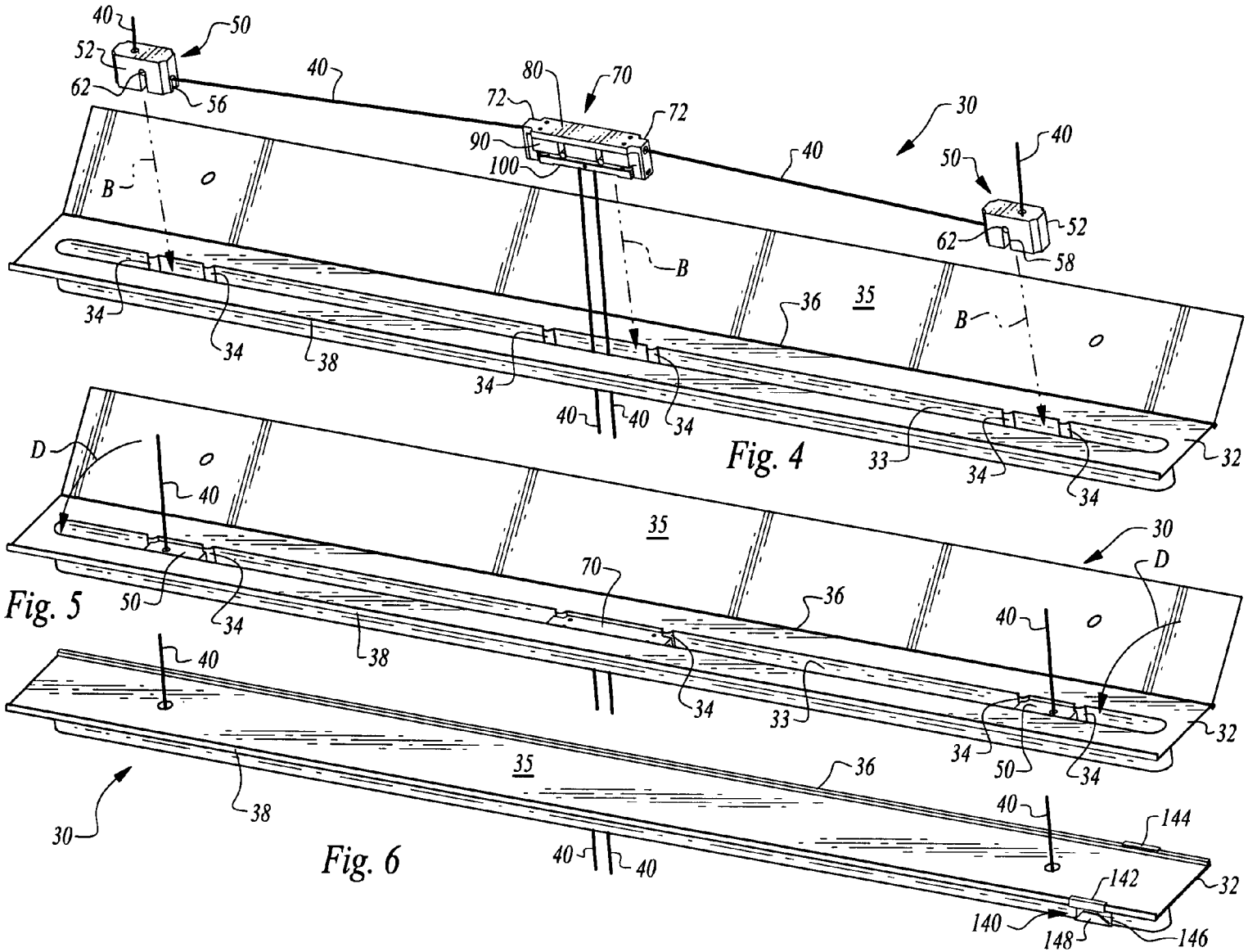
FIG. 4 is a perspective view of a bottom rail of the window covering of this invention with the bottom rail having a cap portion open relative to a base portion and with cord handling mechanisms of the window covering exploded out of a trough in the base portion of the bottom rail to illustrate how the bottom rail is manufactured.
FIG. 5 is a perspective view similar to that which is shown in FIG. 4 but after the cord handling mechanisms have been placed within the trough of the base portion of the bottom rail.
FIG. 6 is a perspective view similar to FIGS. 4 and 5 but with the cap portion of the bottom rail closed, capturing the cord handling mechanisms within the trough of the base portion and with the bottom rail ready for attachment to a lower end of a pleated shade or other at least partially light occluding layer, according to this invention.
Figure 7:
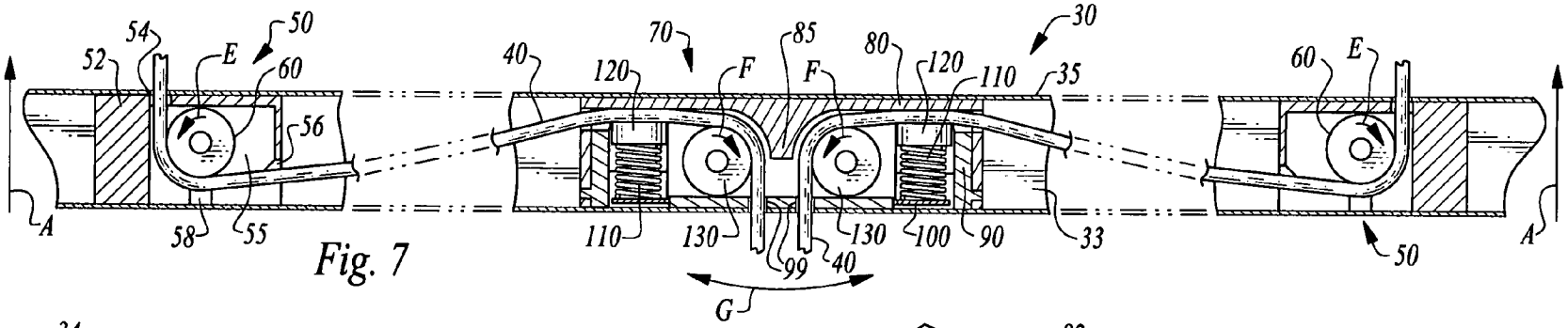
FIG. 7 is a full sectional view of the bottom rail of this invention illustrating function of the pulleys and friction module, and the cord path through the bottom rail.

In essence, and with particular reference to FIGS. 1, 4 and 7, basic details of the shade 10 or other window covering, are described according to a preferred embodiment. The shade 10, illustrative of a preferred form of window covering, includes pleated fabric 20 extending from an upper end 24 to a lower end 26. Preferably, a top rail 25 supports the upper end 24 adjacent the lintel S and allows for fastening of the entire shade 10 to the lintel S. A bottom rail 30 is coupled to the lower end 26 of the pleated fabric 20. This bottom rail 30 preferably includes a base portion 32 and a cap portion 35 coupled together through a hinge 36 to facilitate simple and low cost manufacture. A trough 33 in the bottom rail 30 contains all of the cord 40 handling equipment within the bottom rail 30. The cords 40 extend from the top rail 25, through holes 22 in the pleated fabric 20 down to the bottom rail 30. The cords 40 then pass horizontally through the bottom rail 30 and exit out a bottom of the bottom rail 30 adjacent each other near a center of the bottom rail 30.

Guides 50 are located within the bottom rail 30 which cause the cords 40 to change direction from a vertical orientation to a horizontal orientation. Each guide 50 preferably includes a pulley 60 therein to provide such transition of the cords 40 in a low friction manner.

A friction module 70 is located centrally within the bottom rail 30. The friction module 70 includes a cover 80 with the cords 40 captured between the cover 80 and a body 90 of the friction module 70. Rollers 130 between the body 90 and cover 80 cause the cords 40 to change direction from horizontal to vertical before passing out of the bottom rail 30. A lever 100 is pivotably attached to the body 90 on a side of the body 90 opposite the cover 80. The body 90 includes bores 94 which receive springs 110 therein. Buttons 120 are coupled to upper ends of the springs 110. The springs 110 extend between ends of the lever 100 and the buttons 120, with the buttons 120 abutting the cords 40, pushing the cords 40 against the cover 80 or other portions of the friction module 70.

The springs 110 and buttons 120 thus act together with the cover 80 to act as a friction applying member to apply friction to the cords 40, resisting movement of the cords 40 relative to the friction module 70 and the bottom rail 30. The lever 100 can pivot slightly to adjust friction forces applied by the buttons 120 and springs 110, such that friction forces remain balanced between the two cords 40. A clip 140 (FIGS. 1-3 and 6) is preferably provided on an outboard portion of the bottom rail 30 which allows portions of the cords 40 below the bottom rail 30 to be moved to a side of the window W when the shade 10 is in a retracted position (FIG. 3).

Figure 3:
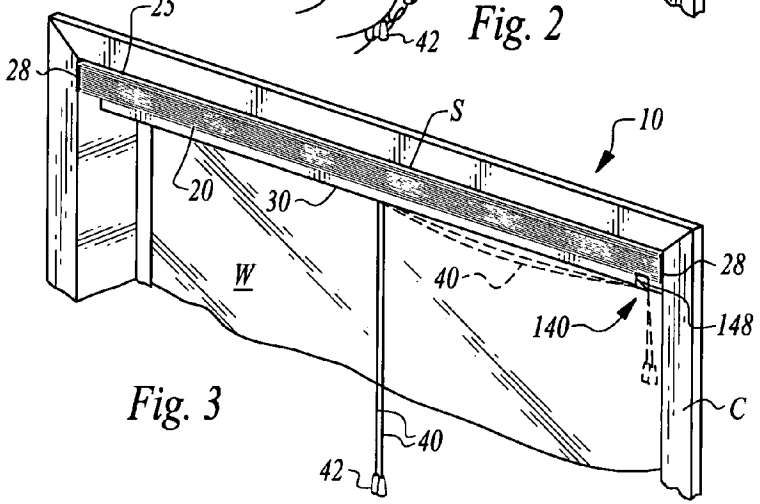
FIG. 3 is a perspective view similar to FIG. 2, but with the window covering fully retracted, and also illustrating function of a cord clip to allow cords to be spaced to a side of the window.

More specifically, and with particular reference to FIGS. 1-3, details of the pleated fabric 20 providing a preferred form of at least partially light occluding layer for the window covering, are described. The pleated fabric 20 has a series of horizontal pleats therein which act as folds in alternating directions so that the pleated fabric 20 has a somewhat accordion expanding and collapsing form. The pleated fabric 20 preferably includes two series of holes 22 vertically spaced from each other passing through each of the pleats of the pleated fabric 20. These holes 22 are sufficiently aligned so that the cords 40 can be routed through each set of holes 22 with the cords 40 extending vertically through the pleated fabric 20.

The pleated fabric 20 is generally rectangular in form with a width between sides 28 that is substantially constant and similar to a width of the casing C surrounding the window W. The pleated fabric 20 extends from the upper end 24 to the lower end 26. The lower end 26 is preferably bonded to the bottom rail 30 or otherwise fastened to the bottom rail 30. The upper end 24 is preferably bonded to or otherwise fastened to the top rail 25. Conceivably, the upper end 24 and top rail 25 could merely be the uppermost pleat in the pleated fabric 20. This uppermost pleat of the pleated fabric 20 could be stiffened somewhat such as by applying a hardenable treatment thereto or otherwise thickening this uppermost pleat in the pleated fabric 20.

Most preferably, the top rail 25 is formed of a separate material which is a plastic polymeric hydrocarbon material, such as is suitably formed by vacuum forming, heat forming, pressing or some combination thereof. Most preferably, this top rail 25 is a substantially planar sheet of constant thickness material, but includes a front lip extending downward slightly on a front edge of the top rail 25. This front lip adds some stiffness to the top rail 25. An adhesive is provided on an upper surface of the top rail 25 suitable to allow the top rail 25 to be attached to the lintel S of the casing C surrounding the window W. As an alternative, the top rail 25 could be attached with fasteners, either to the lintel S or to lateral sides of the casing C, such as through utilization of a compression mount, such as that disclosed in U.S. Publication No. 2006/0081746, incorporated herein by reference.

While the at least partially light occluding layer is preferably in the form of this pleated fabric 20, a fabric that is not pleated could be provided as the at least partially light occluding layer, or the at least partially light occluding layer could be formed of separate slats, such as are common within Venetian blinds. If such slats are provided, an uppermost slat could merely be provided as the top rail, or some other top rail such as the top rail 25 could still be utilized.

The top rail 25 includes holes therein which receive a first end of the cords 40 passing therethrough. Most preferably, the top rail 25 includes a horizontal groove which can receive the cords 40 therein. This groove has just enough depth to receive the cords 40 therein so that portions of the cords 40 above the top rail 25 do not disrupt the substantially planar upper surface of the top rail 25, such that maximum surface area is available for adhesive bonding of the top rail 25 to the lintel S. As an alternative, portions of this groove could be provided as a hole in the top rail 25 so that the portions of the cords 40 above the top rail 25 could pass down through the top rail 25.

With particular reference to FIGS. 4-7, details of the bottom rail 30 providing a preferred form of bottom member are described, according to this preferred embodiment. The bottom rail 30 is an elongate substantially rigid structure which extends substantially horizontally between ends. The bottom rail 30 is preferably formed of two portions, including a base 32 and a cap 35. The base 32 includes a trough 33 therein which receives all of the cord handling mechanisms that reside within the bottom rail 30 (along arrow B of FIG. 4).

Figure 10:
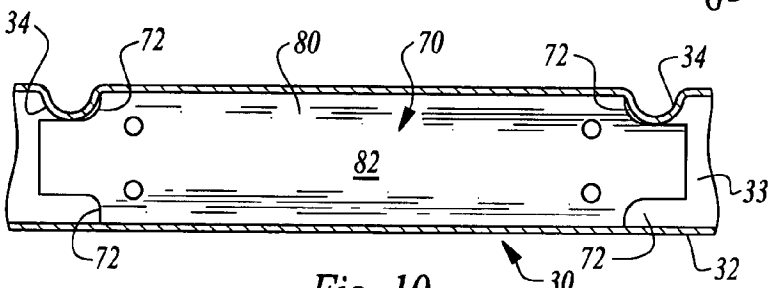
FIG. 10 is a top plan view of the friction module and illustrating further details of the trough within the base portion of the bottom rail.

Ribs 34 are formed in the trough 33 (FIGS. 4, 5 and 10). These ribs 34 extend vertically on a side of the trough 33, preferably a rear side of the trough 33, and can optionally be provided on a front side of the trough 33 or on both front and rear sides of the trough 33. The ribs 34 cause the trough 33 to be slightly narrower where the ribs 34 are provided. The various cord handling mechanisms, including the guides 50 and friction module 70, have a width similar to that of the trough 33 between the ribs 34. Thus, the ribs 34 keep the friction module 70 and guides 50 from moving horizontally and laterally within the trough 33. These ribs 34 are preferably formed merely by shaping of the trough 33 during manufacture of the base 32 to include the ribs 34 therein.

A hinge 36 joins the cap 35 to the base 32. Preferably, this hinge 36 extends entirely along a back edge of the base 32 and cap 35. The hinge 36 is bent so that it can easily flex so that the cap 35 can pivot (about arrow D of FIG. 5) to cause the cap 35 to close over the base 32 to capture the various different cord handling mechanisms within the trough 33 of the base 32 within the bottom rail 30. A lip 38 is preferably provided on a front edge of the base 32. This lip 38 can be curved to catch and hold a front edge of the cap 35 therein. Most preferably, an adhesive is also provided to secure the cap 35 adjacent the base 32 (FIG. 6). The lip 38 also acts to hide the cap 35 from view, providing a clean edge for the front of the bottom rail 30. The lip 38 and hinge 36 also help to align the fabric 20 with the bottom rail 30 during manufacture.

The entire bottom rail 30 is preferably formed from a single sheet of formable material, such as a vacuum formable polymeric hydrocarbon plastic material. This material is initially provided in thin sheets. A combination of pressure, vacuum, press dies having appropriate shapes, and/or heat can be utilized in some combination or individually to take this planar sheet of material and form it into the bottom rail 30 as depicted in FIG. 4 with the cap 35 in an open position. The material is sufficiently thin at the hinge 36 that it can be easily pivoted about the hinge (arrow D of FIG. 5) to close and capture cord handling mechanisms with the trough 33 of the bottom rail 30.

The trough 33 preferably does not quite extend entirely between opposite ends of the bottom rail 30. Rather, the trough 33 preferably stops just short of these ends with a rounded contour at the ends of the trough 33. The trough 33 has a width less than a width between a back edge and front edge of the bottom rail 30. This geometry for the trough 33 and bottom rail 30 causes a stiffness of the bottom rail 30 to be enhanced over what the stiffness would be if the bottom rail 30 were merely formed of planar sheets of material. With such added stiffness, thinner sheets of material and material having lesser inherent stiffness can be utilized and still maintain the bottom rail 30 with adequate stiffness to function according to this invention.

Preferably, both the bottom rail 30, top rail 25 and pleated fabric 20 can all be cut simultaneously for sizing of the shade 10 to fit within the casing S over the window W. Typically, such trimming would occur at each end of the shade 10 outboard of the guides 50 where only pleated fabric 20 and top rail 25 and bottom rail 30 material need be cut. Two similar portions are cut away from each end so that the cords 40 remain a constant distance away from new lateral edges of the shade 10. To provide such appropriate cutting, cutting jigs and measuring guides can be provided to simplify this procedure. Details of such a cutting system could be similar to that described in U.S. Pat. Nos. 6,865,817 and 7,194,811 incorporated herein by reference. Portions of the trough 33 between the guides 50 and ends of the bottom rail 30 are preferably filled with a lightweight stiff foam. The foam helps to hold the trough 33 rigid during cutting and provides an aesthetic solid when the shade 10 is viewed from the end.

With particular reference to FIGS. 1-7, details of the cords 40 are described according to a preferred embodiment. The cords 40 are preferably elongate flexible lines which exhibit little or no elongateability when tension forces are applied thereto, and which exhibit sufficient flexibility to be easily curved about the pulleys 60 or rollers 130 within the trough 33 of the bottom rail 30. Typically, such cords 40 might be formed of braided nylon or braided polyethylene or other braided or non-braided synthetic or natural fibers.

The cords 40 have a length similar to a height of the window W plus a distance between the guides 50 and the friction module 70. With this length, when the bottom rail 30 is in a lowest position corresponding with the shade 10 being fully deployed (FIG. 1) second ends of the cords 40, preferably including dangles 42 thereon, most preferably are located directly adjacent the casing C below the lintel S. The cords 40 can be cut and reknotted within the dangles 42 to facilitate height adjustment for the shade 10. When the bottom rail 30 is raised, corresponding with retracting of the shade 10, the dangles 42 at the second ends of the cords 40 remain substantially stationary as the bottom rail 30 moves up on the cords 40. Similarly, when the bottom rail 30 moves down on the cords 40, the dangles 42 at the second ends of the cords 40 remain substantially stationary adjacent the casing C.

Dangles 42 are optional but allow for easier gripping of the cords 40. The cords 40 need not be gripped when the bottom rail 30 is moved down. When the bottom rail 30 is to be moved up, the cords 40 are gently held (but not pulled). The bottom rail 30 is then lifted up while the cords 40 are held stationary. In one form of the invention, the cords 40 can be removably or permanently attached to portions of the casing C below the lintel S so that the cords 40 always remain taut coupled to the casing C. In such an embodiment, a user never needs to grasp the cords 40. Rather, the bottom rail 40 can merely be grasped and raised or lowered as desired.

With particular reference to FIGS. 1-3 and 6, details of the clip 140 are described according to this preferred embodiment. When the cords 40 are not secured to the casings C, it may be desirable to move the cords 40 out of a position in front of a middle of the window W, when the shade 10 is at least partially retracted (FIG. 3). Preferably, a clip 140 is provided to allow the cords 40 to be so positioned out of blocking a center of the window W. In particular, the clip 140 is a bracket which fits over an outside of the bottom rail 30 and is located adjacent one of the ends of the bottom rail 30. This clip 140 is primarily formed of a contoured plate 146 that has a contour matching that of the base 32 of the bottom rail 30 underneath the base 32. This contoured plate 146 extends from a front tooth 142 which can grasp the lip 38 of the bottom rail 30 back to a rear tooth 144 which can grip over the hinge 36 of the bottom rail 30. Thus, the contoured plate 146 of the clip 140 can slide horizontally onto and be securely held by the bottom rail 30.

A hook 148 extends forward from a portion of the contoured plate 146 so that a saddle is provided between the hook 146 and the contoured plate 148. The cords 40 can rest within this saddle between the hook 148 and the contoured plate 146 so that the cords 40 are out of position (FIG. 3). When the shade 10 is to be deployed, the cords 40 are removed from the clip 140 and returned to their vertical orientation below the bottom rail 30. The user then grasps the bottom rail 30 and pulls down on the bottom rail 30 to move the bottom rail 30 down on the cords 40 to deploy the shade 10 to the extent desired for either partial or fully covering the window W. The clip 140 could be built into the base 32 (or cap 35) of the bottom rail 30 if desired.

Figure 9:
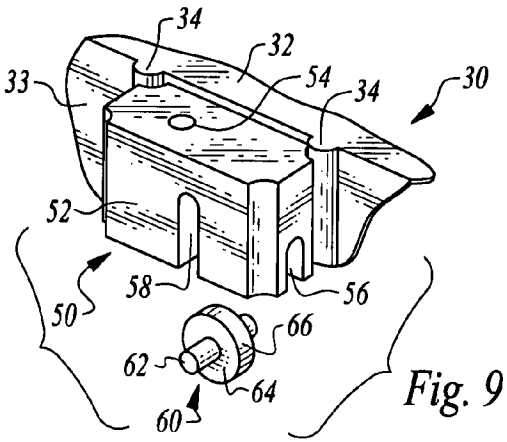
FIG. 9 is a perspective view of a guide and pulley for routing the cords from a vertical orientation passing through the pleated fabric to a horizontal orientation passing through the bottom rail and towards the friction module.
Figure 11:
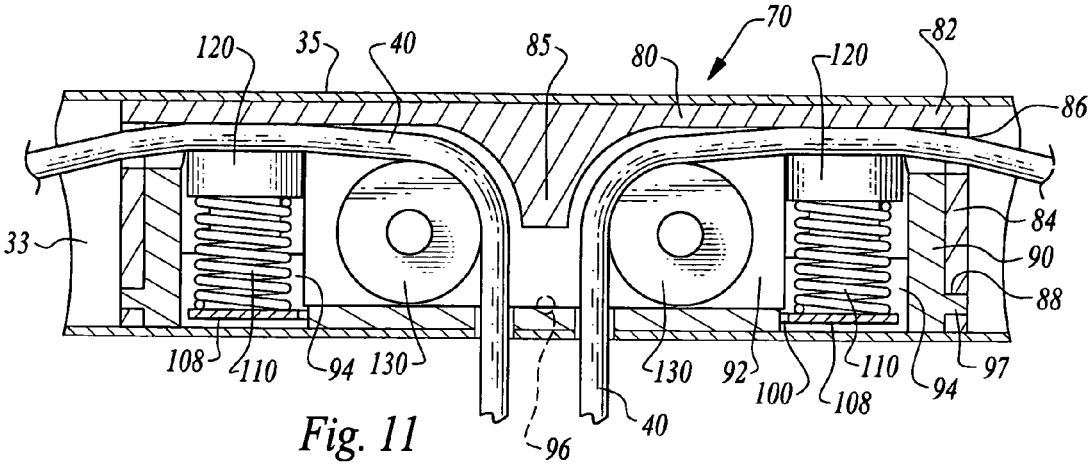
FIGS. 11-13 are details of a central portion of FIG. 7 including the friction module within the bottom rail, illustrating function of the friction applying member and a compensating lever of the friction module according to a preferred embodiment of this invention.

With particular reference to FIGS. 4, 7 and 9, details of the guides 50 and pulleys 60 are described, according to this preferred embodiment. The guides 50 act to turn the cords 40 from a vertical orientation above the bottom rail 30 to a horizontal orientation within the bottom rail 30. While the cords 40 remain stationary between the first end and the second end thereof, as the bottom rail 30 moves, the bottom rail 30 is acting on different portions of the cords 40 between the first end and the second end. Thus, the cords 40 need to roll over different surfaces within the bottom rail 30 to transition from a vertical orientation above and below the bottom rail 30 to a horizontal orientation within the bottom rail 30. The guides 50 provide one such transition, while the friction module 70 including the rollers 130, provides the second such transition.

Each guide 50 is preferably similar in form to simplify manufacture of the shade 10. Guides 50 fit within the trough 33 and generally include a rigid block 52 having a hole 54 in a top surface thereof extending down into a cavity 55. A slit 56 in the lower portion of the block 52 allows a cord 40 to extend horizontally out of the guide 50. The hole 54 allows the cord 40 to extend vertically into the block 52.

A slot 58 is cut into the block 52 transverse to the slit 56. This slot 58 supports the pulley 60 within the cavity 55. In particular, the pulley 60 includes an axle 62 rotatably supporting a wheel 64. The axle 62 sits within the slot 58. The depth of the slot 58 keeps the pulley 60 positioned precisely where desired relative to the hole 54 and the slit 56. The wheel 64 can thus turn on the axle 62 and assist the cord 40 in turning from extending vertically to extending horizontally with low friction when the bottom rail 30 is moving either upward (along arrow A of FIG. 7) or downward (opposite to arrow A of FIG. 7). When the bottom rail 30 is moving upwards (along arrow A of FIG. 7) the pulley 60 is caused to rotate (along arrow E of FIG. 7).

The cord 40 abuts a rim 66 of the wheel 64 with a portion of the rim 66 positioned directly below the hole 54 and horizontal from the slit 56, so that the cord 40 makes a substantially 90° turn about the pulley 60. Preferably, a turn of slightly greater than 90° is provided so that the cord 40 enters an upper portion of the friction module 70 in a center of the bottom rail 30 after passing under the pulley 60.

The guides 50 are retained within the trough 30 both by the ribs 34 and by closing of the cap 35 down onto the base 32. Thus, the guides 50 are secured to the bottom rail 30. Additionally, if desired adhesive can be utilized or fasteners can be utilized to even more securely mount the guides 50 to the bottom rail 30. By keeping the guides 50 fixed within the bottom rail 30, any slack within the cords 40 is inhibited.

While a pulley 60 is preferably provided within each guide 50, it is conceivable that a non-rotating sheave type curving surface could merely be provided and the cords could be allowed to route over this curving surface to transition from a vertical to a horizontal orientation. By providing the pulley 60, friction within the guides 50 is minimized, so that friction is controlled substantially entirely within the friction module 70. However, either fixed or rotating structures could be provided within the bottom rail 30 to provide this cord 40 orientation transition within the bottom rail 30.

Figure 8:
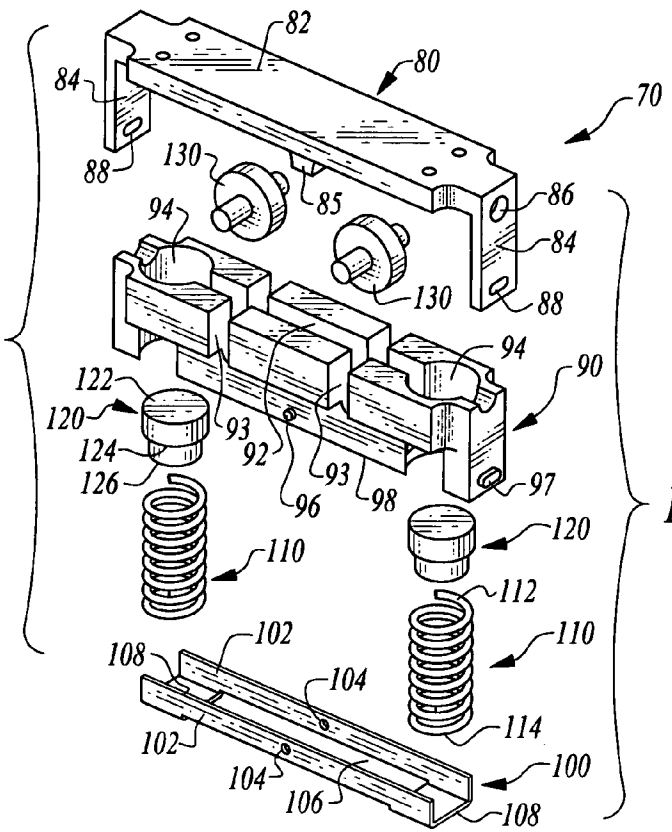
FIG. 8 is an exploded parts perspective view of the friction module including the force applying member, which is provided centrally within the bottom rail of the window covering of this invention.

With particular reference to FIGS. 7 and 8, details of the friction module 70 are described according to this preferred embodiment. The friction module 70 in this preferred embodiment is an assembly of separate parts which together act as the friction applying member for controlling friction applied to the cords 40 relative to the bottom rail 30 so that the bottom rail 30 can be held in fixed position relative to the cords 40 except when additional forces are applied by a user to raise or lower the bottom rail 40. This friction module 70 preferably includes recessed corners 72 to allow the friction module 70 to remain fixed within the trough 33 precisely where desired between ribs 34 of the bottom rail 30. The friction module 70 generally includes a cover 80 coupled to a body 90 with a lever 100 pivotably attached to the body 90, and with pairs of springs 110 and buttons 120 captured within the friction module 70 and with rollers 130 also captured within the friction module 70.

The cover 80 is a rigid elongate structure which provides an uppermost portion of the friction module 70. This cover 80 includes a horizontal top panel 82 with end panels 84 extending vertically down from the top panel 82. Holes 86 in the end panels 84 adjacent the top panel 82 allow the cords 40 to be routed into either end of the friction module 70 through the cover 80. Apertures 88 are provided at lower ends of the end panels 84 most distant from the top panel 82. These apertures 88 coact with prongs 97 on the body 90 to secure the cover 80 upon the body 90.

The cover 80 includes a tender 85 on the lower surface of the top panel 82. This tender 85 acts to keep the cord 40 aligned where desired while passing through the friction module 70. This tender 85 thus has a curving surface that is lowest on a central portion of the top panel 82 and highest adjacent the holes 86. The tender 85 also acts as a reference surface against which the cords 40 are pressed when forces are applied by the spring 110 and button 120 acting on the cords 40 as the friction applying member. The tender 85 is preferably smooth to minimize friction forces on the cords 40. Materials forming the tender 85 are preferably selected so that wear on the cord 40 is minimized when the cords 40 are pressed against the tender 85. Preferably, the tender 85 is formed along with the top panel 82 and other portions of the cover 80 as a single unitary mass of material. This material could be metal, such as stainless steel, or could be an injection moldable hydrocarbon material, such as polyethylene, nylon, delrin or other injection moldable hydrocarbon polymer materials.

The body 90 is preferably a unitary mass of rigid material to which the cover 80 is attached. The body 90 generally has an elongate form with a length similar to that of the cover 80 and a width similar to that of the cover 80 and similar to a width of the trough 33. The body 90 and cover 80 have a height that together is preferably similar to a depth of the trough 33 and defining most of an overall height of the friction module 70. The body 90 includes a central cavity 92 which extends longitudinally within the body 90. This central cavity 92 acts as a space within which the cords 40 can pass as they extend horizontally into the friction module 70 and then vertically out of the friction module 70 and down out of a lower surface of the bottom rail 30 in a vertical direction. Notches are preferably formed in extreme ends of the central cavity 92 that align with the holes 86 in the cover 80 to allow the cords 40 to pass into the friction module 70. These notches are preferably rounded and minimize wear on the cords 40 passing therethrough.

A pair of bores 94 are formed in-line with the central cavity 92 and extending vertically through the body 90 near lateral ends of the body 90. These bores 92 receive the springs 110 and buttons 120 therein. These bores 94 are preferably cylindrical with substantially vertical axes and sized slightly larger than a diameter of the springs 110 to keep the springs 110 properly aligned within the bores 94.

A lower portion of the body 90 is preferably slightly narrower than upper portions of the body 90. This allows these lower portions of the body 90 to pass through a central opening 106 in the lever 100. This lower portion of the body 90 preferably includes a pair of pivot pins 96 extending forward and rearward from the lower portion of the body 90 and near a lowermost portion of the body 90. These pivot pins 96 are just above a floor 98 defining a lowermost portion of the body 90. Ports 99 pass through the floor 98 and allow for the cords 40 to pass vertically out of the friction module 70 and out of the bottom rail 30.

The floor 98 is sized to fit within the central opening 106 of the lever 100. The pivot pins 96 are provided to allow the lever 100 to be pivotably attached to the body 90. Notches 93 are formed substantially perpendicular to the central cavity 92 to support the rollers 130 therein. In particular, the rollers 130 include axles which ride within the notches 93 and allow the roller 130 to rotate within the friction module 70. The cords 40 are routed over the rollers 130 and then down between the rollers 130 before passing through the ports 99 in the floor 98 of the body 90.

The body 90 is preferably formed of a substantially rigid material which can either be injection molded or machined to include the contours described above. Most preferably, the body 90 is formed of injection moldable hydrocarbon polymeric material such as polyethylene. As an alternative, the body 90 could be partially injection molded and then additional machining operations could be provided to finish the formation of the body 90.

The lever 100 is a rigid elongate structure coupled to the body 90. This lever 100 is not strictly necessary, but allows for the friction module 70 to compensate somewhat for variabilities in friction forces that might occur between the bottom rail 30 and the cords 40. This lever 100 includes a pair of rails 102 on front and rear sides of the lever 100 which reside on either side of the lower portion of the body 90. These rails 102 are spaced apart a distance similar to that of a width of the trough 33 in the bottom rail 30. Pivot holes 104 are formed in each of the rails 102 to receive the pivot pins 96 of the body 90 therein. The lever 100 can thus pivot about these pivot holes 104 and the pivot pin 96 of the body 90 somewhat.

The lever 100 includes a central opening 106 between the rails 102 through which the floor 98 of the body 90 can extend. Thus, the floor 98 can be supported against a bottom of the trough 33 and the lever 100 is actually raised slightly above the floor of the trough 33 to facilitate pivoting of the lever 100 (about arrow G of FIGS. 7, 12 and 13). Pads 108 join the two rails 102 together at each end of the lever 100. These pads 108 are sized to fit within lower portions of the bores 94 of the body 90. The pads 108 abut against the springs 110 on sides of the springs 110 opposite the buttons 120.

The spring 110 is preferably a helical compression spring having a length similar to a distance between the pads 108 of the lever 100 and the buttons 120, but sufficiently greater to put the spring 110 into compression, so that the buttons 120 push on the cords 40, with the buttons 120 below the cords 40 as the cords 40 pass horizontally into the friction module 70 through the holes 86 in the cover 80. The springs 110 extend from a top 112 adjacent each button 120 to a bottom 114 adjacent each pad 108 of the lever 100.

Each button 120 is a rigid mass of material having an engagement surface 122 on an uppermost portion thereof which is adapted to abut against the cord 40 as it passes above the bore 94 in the body 90 and below the tender 85 of the cover 80. The button 120 includes a step 124 below the engagement surface 122. A boss 126 extends down below this step 124 with the boss 126 having a diameter less than that of portions of the button 120 above the step 124. While the button 120 could have various different cross-sectional forms, it preferably has a circular form such that the buttons 120 can be oriented in a non-specific manner and still provide force on the cords 40 corresponding with a diameter of the engagement surface 122 of the button 120.

The step 124 is sized to cause portions of the button 120 above the step 124 to have a greater diameter than that of the spring 110 and portions of the boss 126 below the step 124 on the button 120 to have a diameter less than that of the spring 110. Thus, the boss 126 resides within the spring 110 and the spring 110 abuts against the button 120 at the step 124. In this way, the button 120 remains aligned with the associated spring 110 at all times.

The springs 110 act as biasing members to bias the buttons 120 against the cords 40 and to apply friction on the cords 40 within the friction module 70. This friction applied by the springs 110 through the buttons 120 is sufficient to resist gravity forces acting on the shade 10 including the pleated fabric 20 and the bottom rail 30. Thus, the bottom rail 30 is at equilibrium and remains stationary regardless of whether the bottom rail 30 is positioned close to the top rail 25 or is positioned far from the top rail 25.

When additional forces are applied by a user, such as by gripping the bottom rail 30 and pulling down or pushing up on the bottom rail 30, these friction forces are easily overcome and the bottom rail 30 can be moved relative to the cords 40. In particular, to lower the shade 10 force greater than the friction force applied by the friction module 70 minus gravity forces acting on the shade 10 must be applied to lower the shade 10. To raise the shade 10, force greater than the friction force applied by the friction module 70 plus the gravity force must be applied.

The rollers 130 are provided to minimize friction associated with turning the cords 40 from horizontal above the roller 130 to vertical below the rollers 130, by rotation along arrow F.

Figure 12:
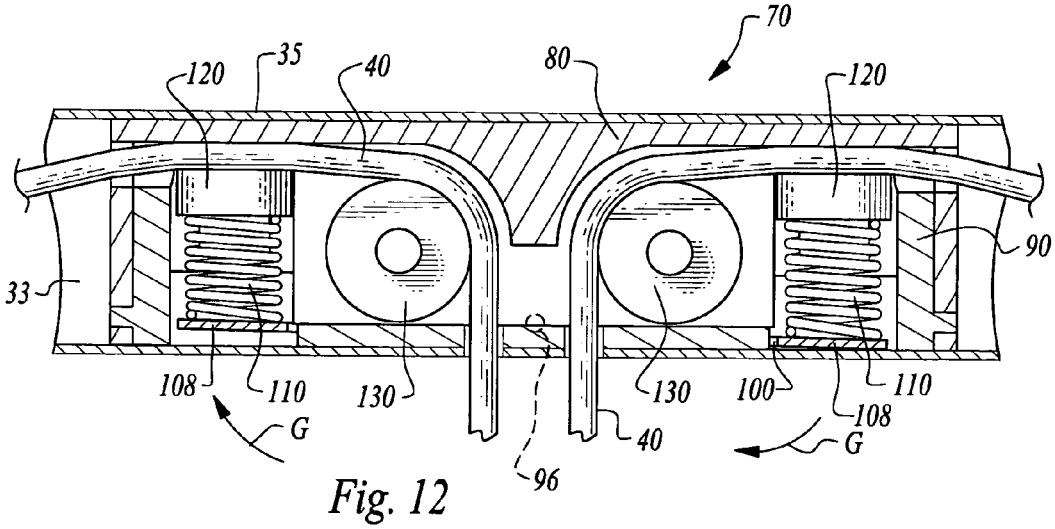
Figure 13:
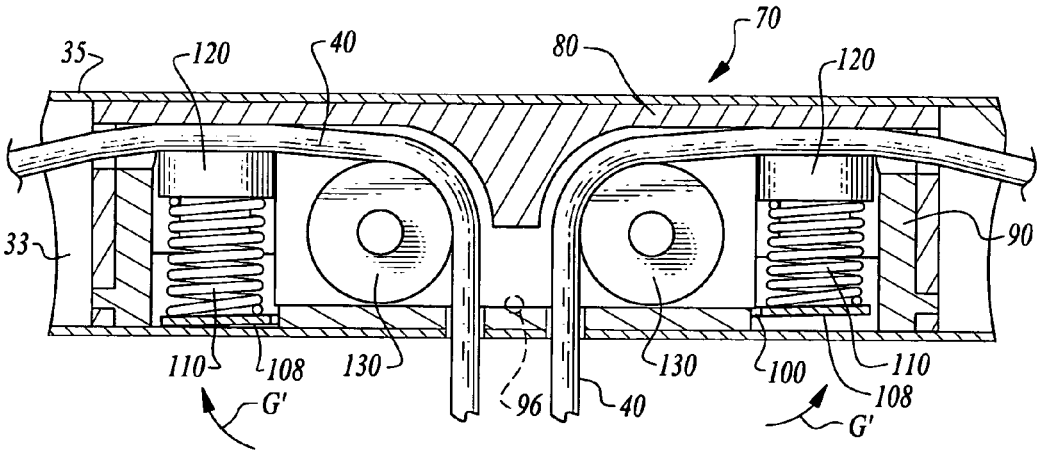

Because the lever 100 can pivot somewhat about the pivot pin 96, the height of the springs 110 is adjusted somewhat by pivoting of the lever 100 (about arrow G of FIGS. 7, 12 and 13). Pivoting of the lever 100 acts as a compensator to balance friction forces applied on each of the cords 40, so that any differential in friction forces applied to each cord 40 are minimized or eliminated and the shade 10 can remain balanced (or closer to balanced) with the bottom rail 30 remaining substantially horizontal. For instance, the cords 40 might have portions thereof which are thicker or thinner than other portions. If a thin portion of a cord 40 passes over one of the buttons 120, less friction would be encountered on that cord 40, tending to cause the shade 10 to become slightly unbalanced (i.e. the bottom rail 30 rotating away from horizontal). With the lever 100 pivoting against the body 90, if such a thin portion of cord 40 passes over the button 120, reaction forces applied by the cord 40 down on the button 120 are diminished somewhat relative to reaction forces applied by the other cord 40 on the other button 120. The lever 100 is thus caused to pivot slightly with portions of the pad 108 of the lever 100 below the thinner portion of cord 40 moving upward slightly. With such upward movement of the lever pad 108, friction forces are restored between the button 120 and the cord 40, so that the friction forces on the cord 40 remain substantially constant even if a thin portion of cord 40 is encountered. Simultaneously, the pad 108 on the opposite side of the lever 100 is caused to pivot downward reducing friction forces on the other cord 40. In this way, overall balance between the two cords is achieved. If the bottom rail 30 still rotates away from horizontal, the bottom rail 30 can be restored to horizontal by holding the cords 40 taut below the bottom rail 30 and pulling down on one side of the bottom rail 30 that is higher until a horizontal orientation is attained.

This lever 100 not only acts to balance the bottom rail 30, but also acts as a mechanism to allow a user who can't reach the bottom rail 30 to still lower the bottom rail 30 to deploy the shade 10 over the window W. In particular, the user can grip merely one of the cords 40 and tug lightly on that cord 40. With such light tugging, reaction forces between the cord 40 being tugged and the button 120 and spring 110 below the cord 40 being tugged are increased. This causes the bottom rail 30 to pivot somewhat about the cord 40 friction point with the button 120, so that the end of the bottom rail 30 opposite the cord 40 being pulled moves down slightly. The user can then pull on the second cord 40 to cause the other end of the bottom rail 30 to move down slightly. By alternately pulling on each cord 40, the bottom rail 30 is caused to incrementally move down the cords 40. Once the bottom rail 30 has moved down sufficiently, the user can then grasp the bottom rail 30 and pull down on the bottom rail 30 to position the bottom rail 30 where desired.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A window covering exhibiting simple positioning of the covering as desired, the window covering comprising in combination:

an at least partially light occluding layer;

said layer extending between an upper end and a lower end, said upper end adapted to be attached to a lintel above a window;

said layer adapted to be adjusted in height between said upper end and said lower end;

a substantially rigid bottom member coupled to said lower end;

at least one cord having a first end held in fixed position relative to said upper end of said layer and a second end opposite said first end extending past said bottom member;

said cord routed through a friction applying member coupled to said bottom rail, said friction applying member applying enough friction force to said cord to keep said bottom member in fixed position relative to said cord when only gravity loads are applied to said bottom member and said layer;

wherein said friction applying member includes a housing fixed to said bottom member, said housing including a cord path passing adjacent said housing, said housing including a movable engagement surface therein biased against said cord to apply friction to said cord within said housing;

wherein said movable engagement surface is located upon a surface of a button with a compression spring abutting against a surface of said button opposite said movable engagement surface, said compression spring applying force on said button pushing said button against said cord lateral to a length of said cord; and wherein at least one roller is located within said housing, said at least one cord routed around said roller to transition said cord from extending in a horizontal direction to extending in a vertical direction, said spring and said button oriented to apply friction force on said cord where said cord extends horizontally through said housing before passing over said roller and extending substantially vertically out of said housing and out of a bottom of said base member.

2. The window covering of claim 1 wherein said bottom member is in the form of a bottom rail with an elongate trough therein, said trough including said housing within a central portion of said trough, said trough including a pair of guides spaced horizontally from said housing within said trough, said trough including ribs on horizontal ends of said housing and horizontal ends of said guides, said trough having a width greater than said housing and greater than said guides such that said housing and said guides fit within said trough, said ribs narrowing said trough to a width less than said housing and less than said guides at said ribs, such that said ribs prevent said housing and said guides from moving horizontally within said trough, wherein at least two cords extend from first ends fixed relative to said upper end of said at least partially light occluding layer down to said bottom rail where each of said cords are routed through one of said guides to transition said cords from a vertical direction to a horizontal direction, then routing said cords between said guides and said housing and over a pair of said rollers within said housing with a pair of buttons having movable engagement surfaces thereon and a pair of springs with each of said springs applying a force on said buttons, such that each of said buttons applies a friction force to one of said cords, said cords then routed vertically down from said rollers out of said bottom rail and downward substantially parallel and adjacent to each other below said bottom rail.

3. The window covering of claim 2 wherein ends of said springs opposite said buttons abut opposite ends of a substantially rigid lever, said lever pivotably attached to said housing at a midpoint between ends thereof, said housing having said rollers rotatably coupled thereto, said housing including a reference surface opposite said movable engagement surface of said buttons, said pivotable attachment of said lever to said housing being at a fixed location relative to said reference surface, said lever adapted to pivot slightly about said pivotable attachment to simultaneously add compression forces to one of said springs while removing compression forces from the other of said springs, to compensate for differences in friction forces applied to each of said cords, such that friction forces applied to each of said cords are closer in magnitude than they would be without said lever.

4. The window covering of claim 1 wherein said at least partially light occluding layer includes a pleated fabric having a series of pleats extending horizontally with a series of holes passing through said pleated fabric, said at least one cord routed through said holes in a substantially vertical orientation between said upper end and said lower end.

5. The window covering of claim 1 wherein a top rail is coupled to said upper end of said layer, said top rail exhibiting greater rigidity than said at least partially light occluding layer, said top rail having said first end of said cord attached thereto, said top rail adapted to be attached to the lintel above the window.

* * * * *